US007494392B1

(12) United States Patent
Latham

(10) Patent No.: US 7,494,392 B1
(45) Date of Patent: Feb. 24, 2009

(54) OUTBOARD MOTOR SHAFT SUPPORT

(76) Inventor: Robert P. Latham, 280 SW. 32 Ct., Fort Lauderdale, FL (US) 33315

( * ) Notice: Subject to any disclaimer, the term of this patent is extended or adjusted under 35 U.S.C. 154(b) by 0 days.

(21) Appl. No.: 12/214,120

(22) Filed: Jun. 17, 2008

Related U.S. Application Data

(63) Continuation-in-part of application No. 11/652,229, filed on Jan. 12, 2007, now abandoned.

(51) Int. Cl.
*B63H 23/34* (2006.01)

(52) U.S. Cl. ..... 440/83; 440/76

(58) Field of Classification Search ..... 440/76, 440/83, 88 D
See application file for complete search history.

(56) References Cited

U.S. PATENT DOCUMENTS 2,549,477 A * 4/1951 Kiekhaefer ..... 440/78
6,146,222 A * 11/2000 Murata et al. ..... 440/83
7,182,658 B2 * 2/2007 Asakaze et al. ..... 440/88 L

* cited by examiner

*Primary Examiner*—Ed Swinehart
(74) *Attorney, Agent, or Firm*—Alvin S. Blum

(57) ABSTRACT

A marine outboard motor has a rotary bearing on the vertical drive shaft intermediate its ends. This bearing is mounted in a housing that joins the power head to the lower unit. The bearing prevents failure that may occur when the shaft has an unbalance that causes bowing and whipping of the shaft at certain speeds. The bearing is supplied with water from a water pump in the lower unit.

15 Claims, 7 Drawing Sheets

OUTBOARD MOTOR SHAFT SUPPORT

This is a continuation-in-part of application Ser. No. 11/652,229 filed Jan. 12, 2007 now abandoned incorporated herein by reference.

FIELD OF THE INVENTION

This invention relates generally to marine outboard motors, and more particularly to bearing support for the vertical drive shaft intermediate the shaft ends.

BACKGROUND OF THE INVENTION

Marine outboard motors have a power head whose output crankshaft is coupled to an elongate vertical power shaft. The rotating shaft passes through a mid-section to a lower unit where it is coupled by a right angle gear assembly to the horizontal propeller shaft that turns the propeller. The shaft is well supported at its two ends by rotary bearings. To accommodate some marine applications such as a high transom, the outboard motor may be configured with a long shaft so that the lower unit is at an increased distance from the power head. A spacer is generally inserted between the lower unit and the mid-section along with the longer shaft. Problems occasionally arise with the increased length, power, and speed of rotation of these long shaft configurations. It has been found that high torque and great rotary speed may cause the shaft to bow out between its unsupported ends from centrifugal forces. When a resonant frequency of rotation is reached, even very slight unbalances in the rotating shaft causes slight bending that becomes cumulative. The term "whipping" is applied to this phenomenon. When it exceeds a certain limit, it may result in failure.

SUMMARY OF THE INVENTION

In accordance with an aspect of the invention, a system is described that provides a rotary bearing support for the shaft intermediate its ends. A marine outboard motor of the invention includes a power head or engine that drives a vertical crankshaft. An elongate vertical drive shaft is coupled to the rotary output assembly of the crankshaft, usually by a female spline that mates with a male spline on the upper end of the drive shaft. A lower unit has a horizontal propeller shaft coupled at its distal end to a propeller. A gear assembly rotatably connects a lower end of the drive shaft to the proximal end of the propeller shaft. A water pump in the lower unit supplies cooling water to the power head. One or more housings connect the power head to the lower unit. The drive shaft passes through the housing(s). A rotary bearing supports the shaft between the ends. It is mounted in a bearing assembly that is cooled by a flow of water through a tube connected to a water pump in the lower unit. By supporting the shaft where it has a tendency to bend, the bending is prevented. Using an efficient water cooled cutless bearing, there is no significant power loss. The result is that a long shaft can be accommodated without incurring the inherent danger of failure. In another embodiment of the invention, a bearing assembly mountable to a housing member is provided for retrofitting an outboard motor to improve reliability.

These and other objects, features, and advantages of the invention will become more apparent from the detailed description of a exemplary embodiments thereof as illustrated in the accompanying drawings, in which like elements are designated by like reference characters in the various drawing figures.

DETAILED DESCRIPTION OF PREFERRED EMBODIMENTS

Before explaining the disclosed embodiments of the present invention in detail, it is to be understood that the invention is not limited in its application to the details of the particular arrangements shown, since the invention is capable of other embodiments. Also, the terminology used herein is for the purpose of description and not limitation.

Figure 1:
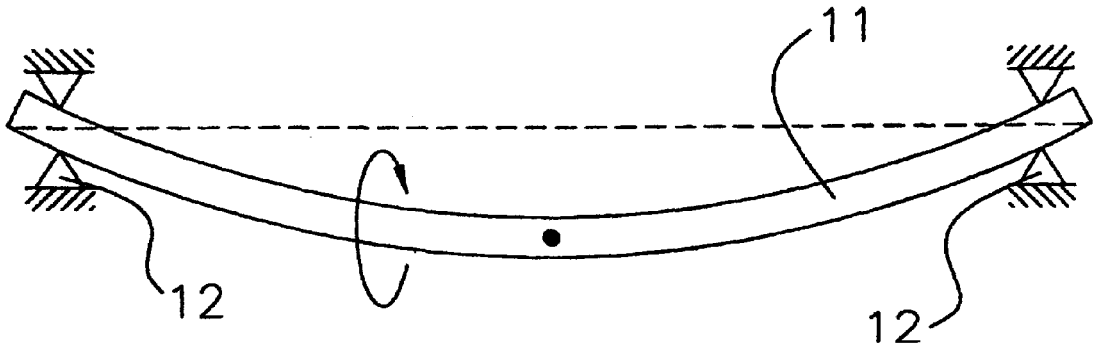
FIG. 1 is a diagrammatic representation of the mechanism of failure of a drive shaft rotatably supported only at its ends.
Figure 2:
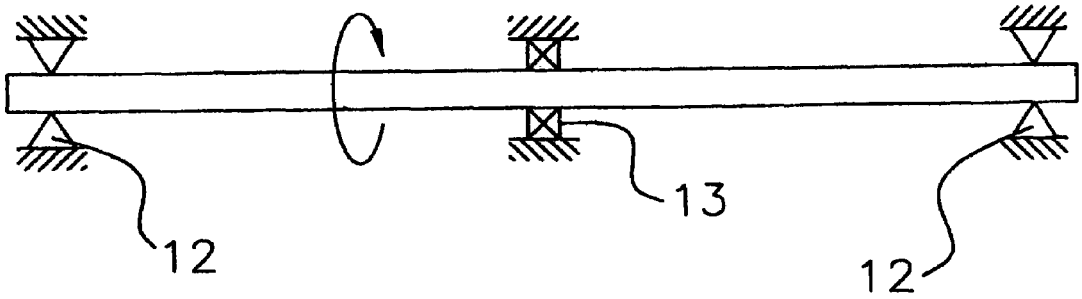
FIG. 2 is a diagrammatic representation of a drive shaft rotatably supported intermediate its ends as well as at its ends.
Figure 3:
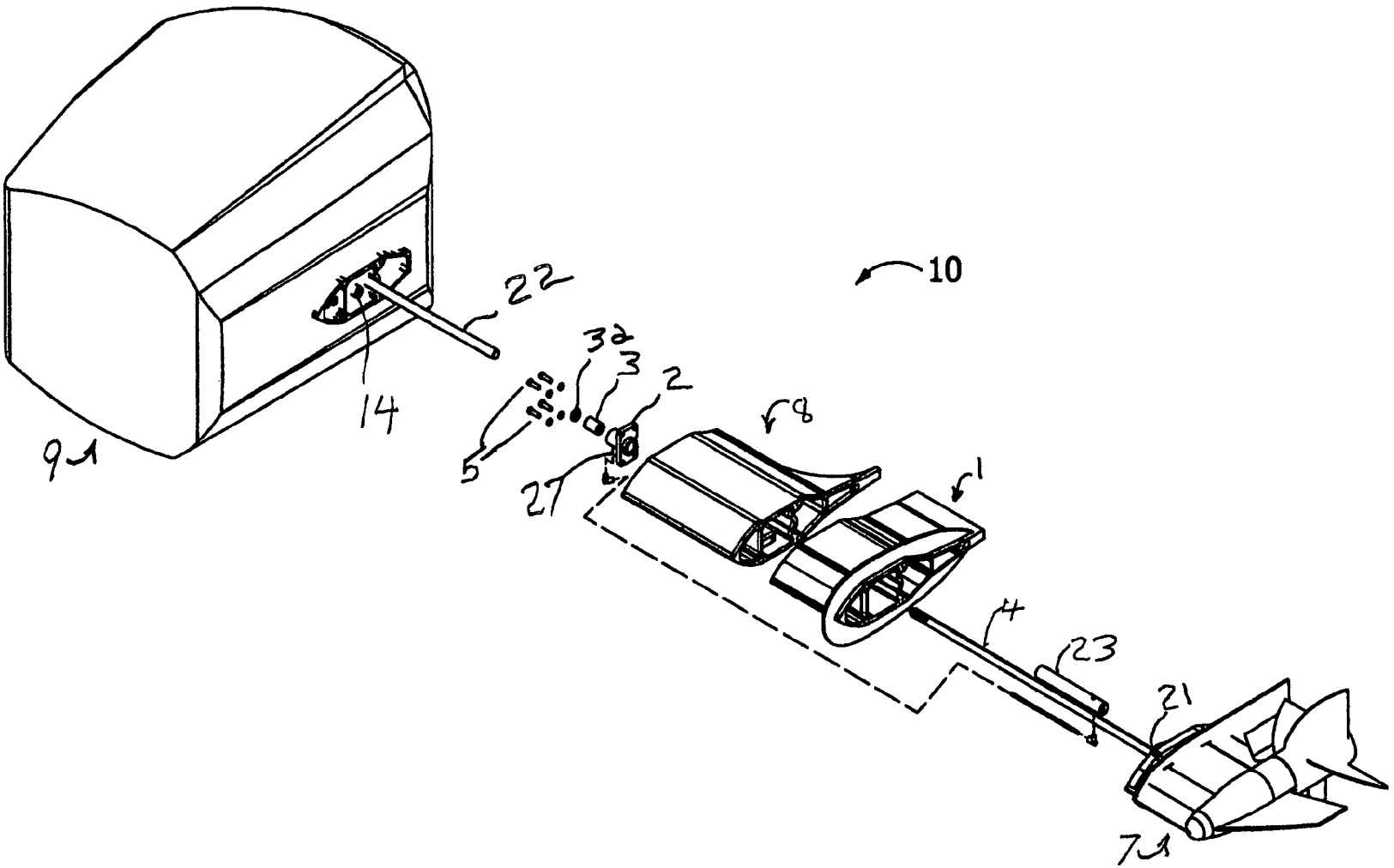
FIG. 3 is an exploded perspective view of an outboard motor of the invention.
Figure 6:
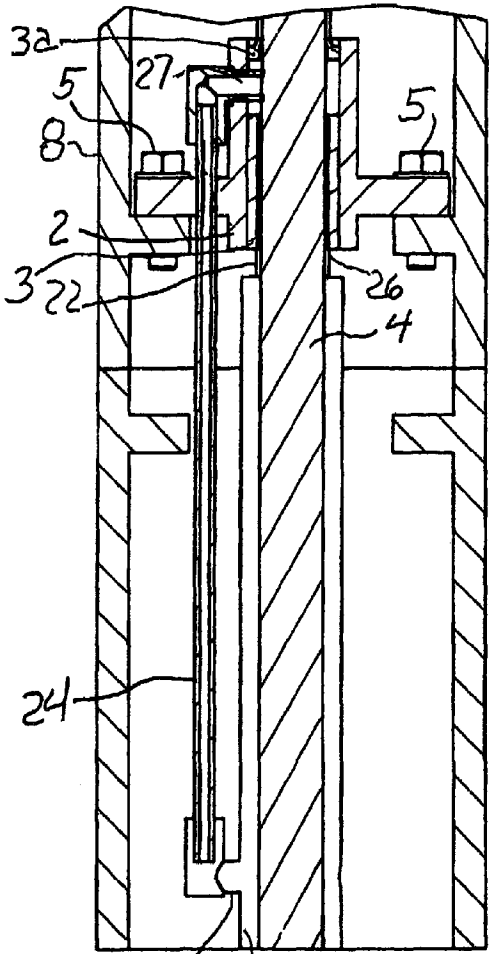
FIG. 6 is a detail of portion B of FIG. 5.
Figure 5:
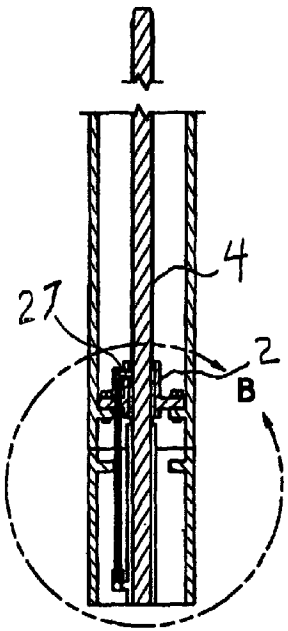
FIG. 5 is a sectional view through line 5-5 of FIG. 4.
Figure 4:
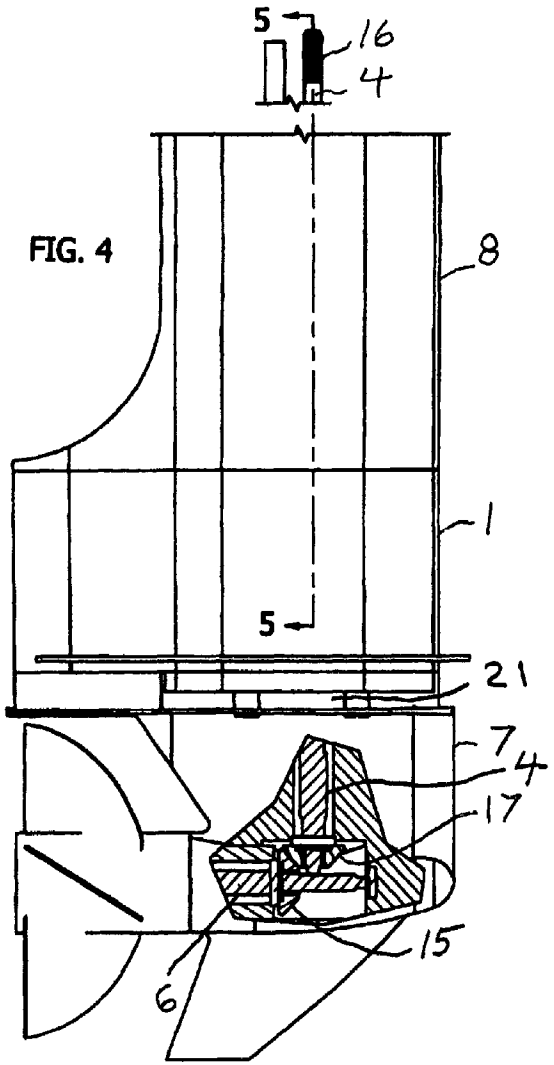
FIG. 4 is a side elevation view, partially cut away, of a portion of the outboard motor.
Figure 9:
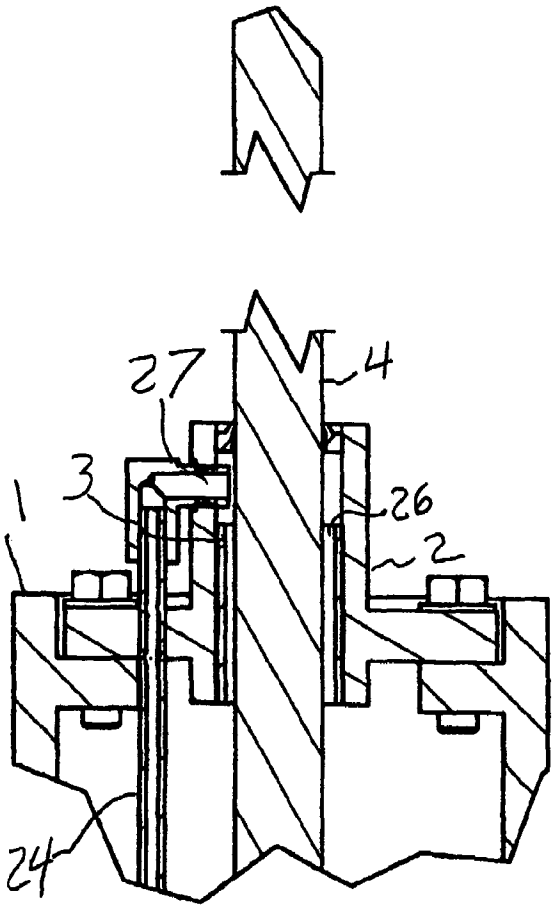
FIG. 9 is a detail of portion H of FIG. 8.
Figure 8:
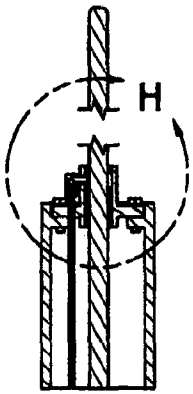
FIG. 8 is a sectional view through line 8-8 of FIG. 7.
Figure 7:
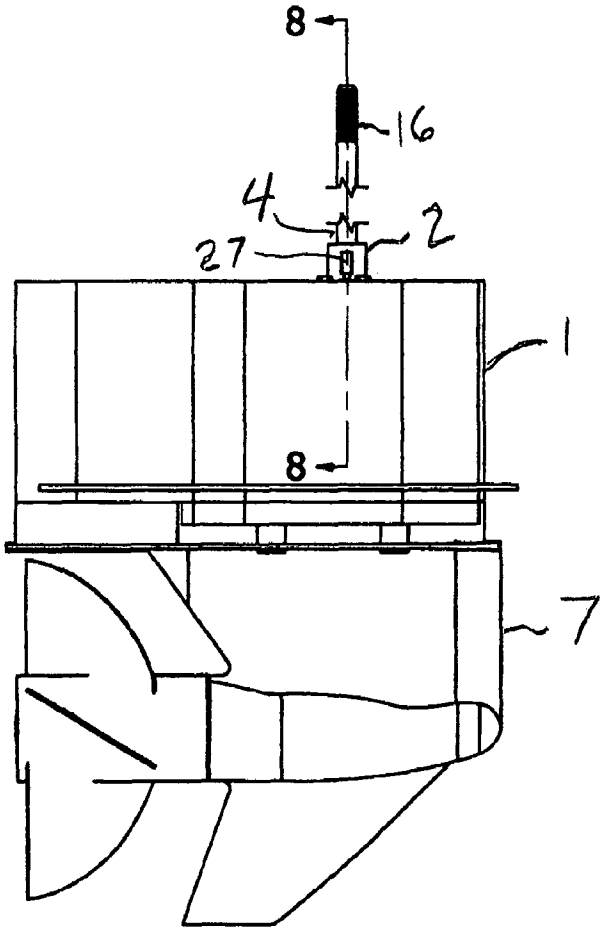
FIG. 7 is a side elevation view of another embodiment of the invention.
Figure 10:
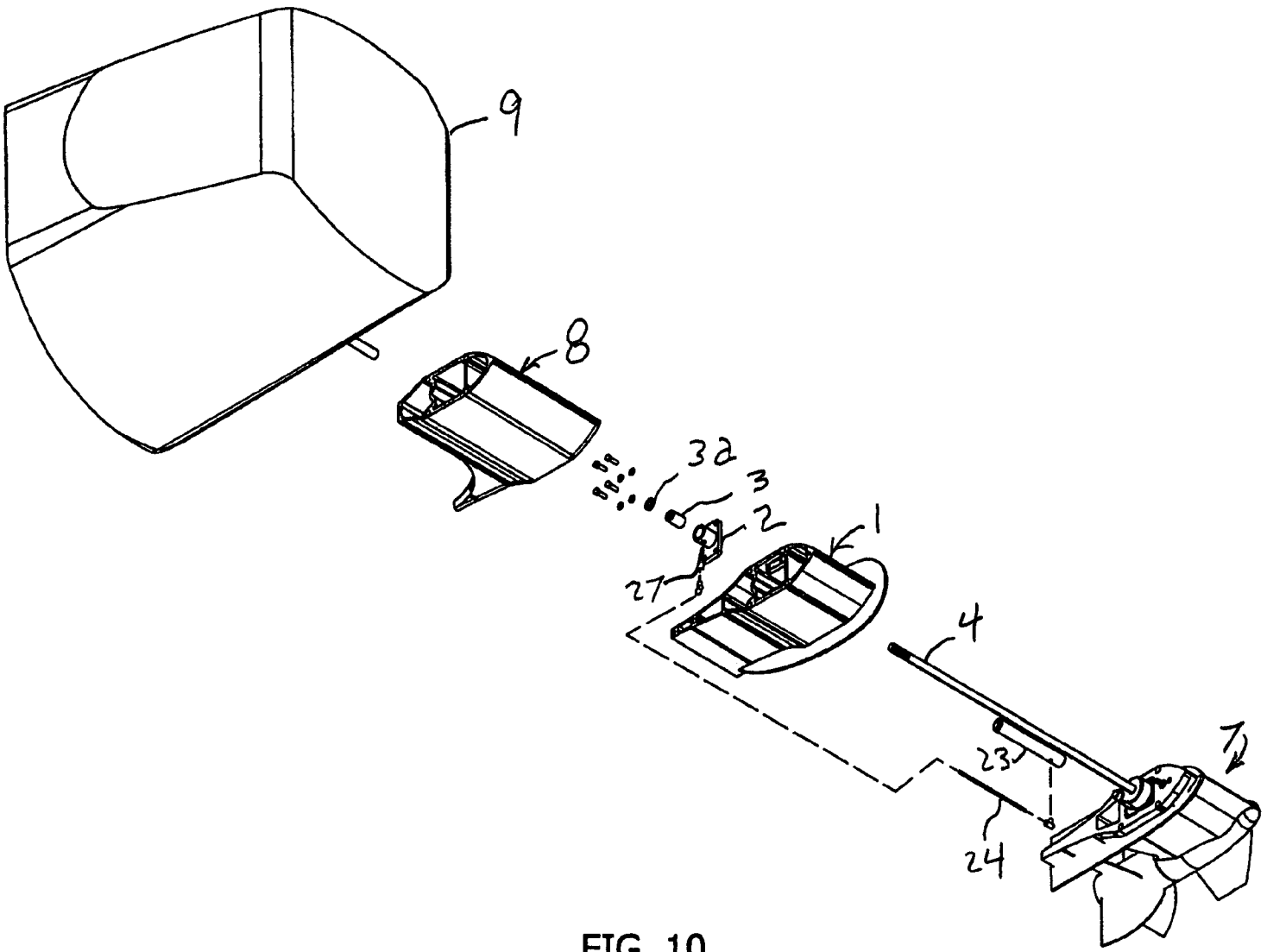
FIG. 10 is an exploded perspective view of the embodiment of FIG. 7.
Figure 11:
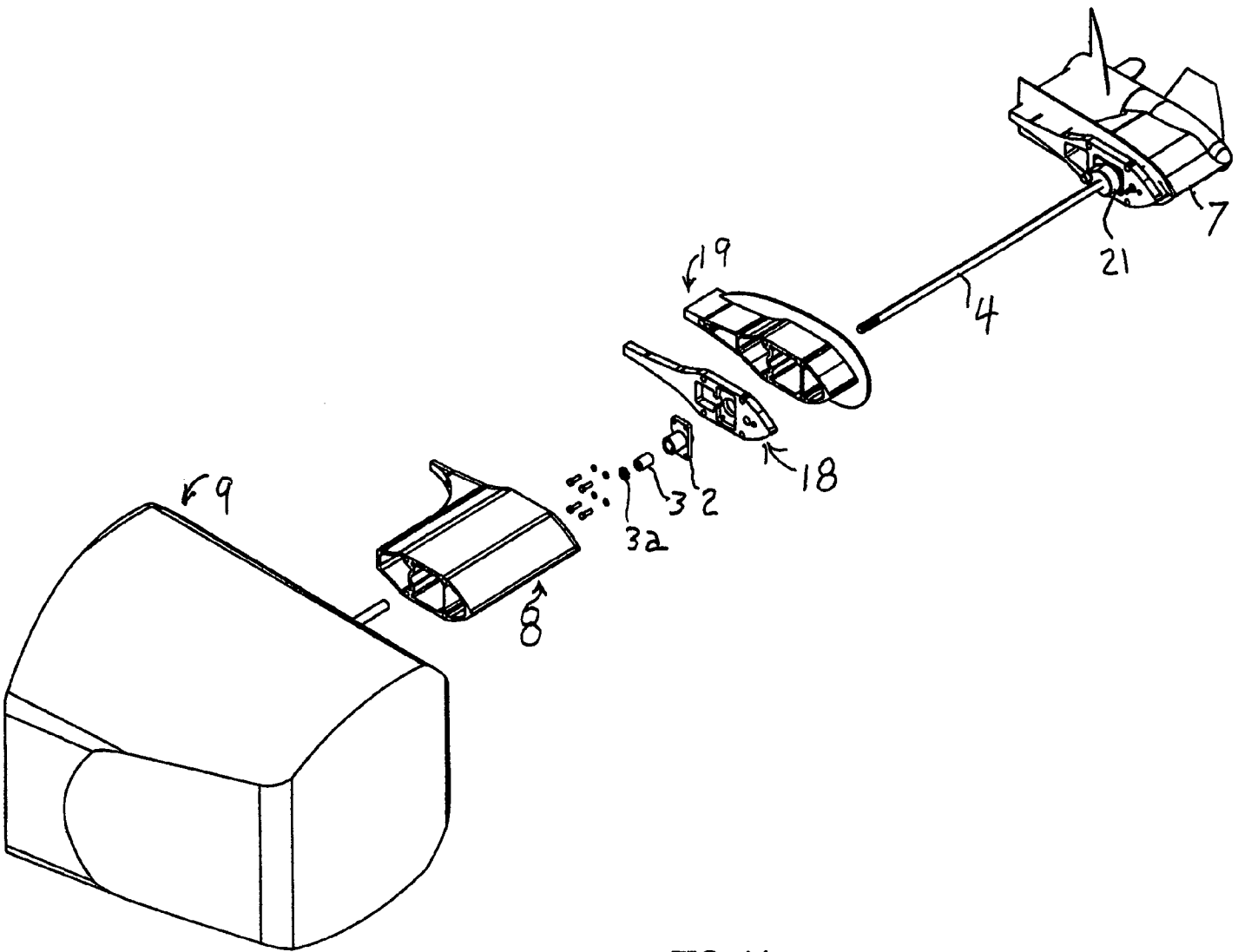
FIG. 11 is an exploded perspective view of another embodiment of the invention.
Figure 14:
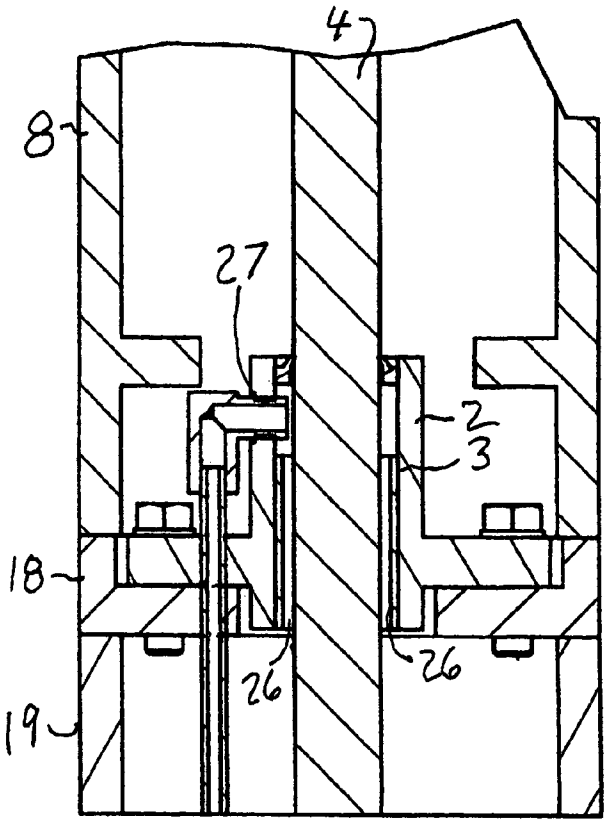
FIG. 14 is a detail of portion K of FIG. 13.
Figure 13:
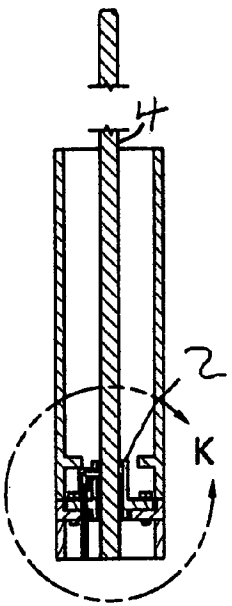
FIG. 13 is a sectional view through line 13-13 of FIG. 12.
Figure 12:
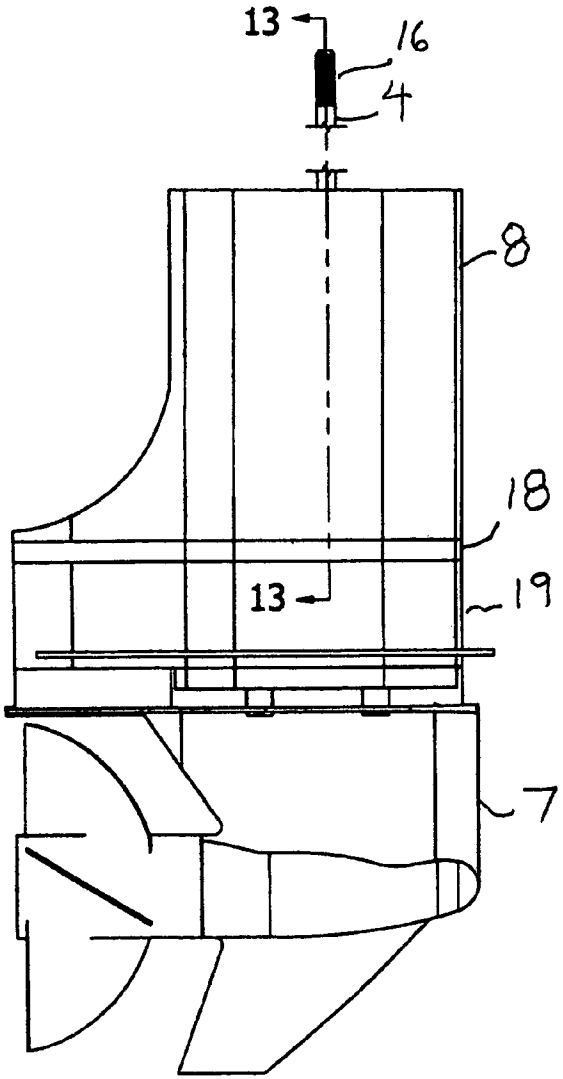
FIG. 12 is a side elevation view of a portion of the outboard motor of FIG. 11.

Referring now to FIG. 1, a rotating shaft 11 is supported by ends bearings 12 If there are unbalanced masses in the rotating assembly, then centrifugal forces will tend to bend the shaft. The result will be high amplitude bending when the rotational speed coincides with the transverse natural frequency of the rotating mass. This resonant action can result in failure of the shaft or its supports. Referring now to FIG. 2, it is shown that the same shaft 11 rotating at the same speed as in FIG. 1, with a center bearing 13 in addition to the end bearings 12 will not fail because the bending action is limited by the bearing 13.

Referring now to FIGS. 3-6, a marine outboard motor 10 of the invention includes a conventional power head 9 driving a rotary output assembly 14. A conventional lower unit 7 has a horizontal propeller shaft 6 driven by a right angle gear assembly 15. A vertical drive shaft 4 is coupled at its upper end 16 to the rotary output assembly 14 of the power head, usually by a spline connection. A lower end 17 of the shaft 4 is rotatably coupled to the right angle gear assembly. An upper mid-section housing member 8 and a lower mid-section housing member 1, usually termed a "spacer" rigidly connect the power head to the lower unit. The vertical shaft 4 passes through the members 8 and 1. It is provided with good radial support at its upper and lower ends. These configurations are well known in the prior art. The shaft is provided with a radial bearing 3 and seal 3*a* intermediate the shaft ends to overcome the deficiencies in the prior art by preventing the bending of the shaft. Outboard motors with substantial power have a water pump 21 in the lower unit. This pumps water in which the lower unit is immersed up through water pipe 22 to the power head 9 to cool the engine. When a spacer 1 is added to extend the elevation of the power head above water, a water pipe extension 23 is installed.

To cool and lubricate the bearing 3 of the instant invention, the water pipe extension 23 is provided with a side outlet 25 to which an auxiliary water pipe 24 is connected that feeds water to the water connector 27 of bearing assembly housing or carrier 2. The housing 2 is provided with an upper water seal 32 to prevent upward flow of the cooling water. Water flows downward through grooves 26 on the inner perimeter of the bearing 3 to cool and lubricate the bearing. The bearing 3 is securely mounted in bearing carrier 2, which may include a resilient element 20 to further dampen vibrations. Bearing carrier 2 is mounted within member 8 by bolts 5. In an alternative embodiment not shown the outboard motor of the invention may be provided without the spacer member 1. A member 8 with bearing 2 installed therein may be provided to retrofit an outboard motor by replacing a convention housing member 8.

Referring now to drawing FIGS. 7-10, another embodiment of the invention is shown in which the bearing 3 and bearing carrier 2 are mounted in a lower one 1 of the at least two mid-section housing members 8 and 1 that is generally referred to as a "spacer".

Referring now to drawing FIGS. 11-14, another embodiment of the invention is shown in which the bearing 3 and bearing carrier 2 are mounted in a special housing in the form of plate 18. This plate is mounted between the conventional mid-section 8 and conventional spacer 19. The water pump 21 in lower unit 7 is better seen in FIG. 11. This embodiment is more economical to manufacture and enables retrofitting of existing motors with minimal alteration of configuration.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. An outboard motor comprising:

a power head driving a rotary output assembly;

a vertical drive shaft having an upper end coupled to the rotary output assembly;

a lower unit having a water pump and a horizontal propeller shaft;

a tubular passage in fluid connection at a first end with the water pump and at a second end with the power head for cooling the power head;

a gear assembly rotatably connecting a lower end of the drive shaft to the propeller shaft;

at least one mid-section housing member, through which the drive shaft passes, connecting the power head to the lower unit;

the drive shaft being supported at its upper and lower ends by power head and lower unit rotary bearings;

a mid-section rotary bearing supporting the drive shaft intermediate the upper and lower ends thereof;

the mid-section rotary bearing mounted in a bearing assembly cooled by water through a tubular fluid connection to the tubular passage; and the bearing assembly being mounted in one of the at least one mid-section housing member.

2. The outboard motor according to claim 1 in which the bearing assembly is resiliently mounted in the mid-section housing member.

3. The outboard motor according to claim 2 in which there are two mid-section housing members, and the bearing assembly is mounted in a lower one of the mid-section housing members.

4. The outboard motor according to claim 1 in which there are two mid-section housing members, and the bearing assembly is resiliently mounted in a lower one of the mid-section housing members.

5. The outboard motor according to claim 2 in which there are two mid-section housing members, and the bearing assembly is mounted in an upper one of the mid-section housing members.

6. The outboard motor according to claim 1 in which there are two mid-section housing members, and the bearing assembly is resiliently mounted in an upper one of the mid-section housing members.

7. In an outboard motor having a power head driving a rotary output assembly in an uppermost housing member;

a vertical drive shaft having an upper end coupled to the rotary output assembly, a lower unit having a water pump and a horizontal propeller shaft in a lowermost housing member, the drive shaft being supported at its upper and lower ends by power head and lower unit rotary bearings, a tubular passage in fluid connection at a first end with the water pump and at a second end with the power head for cooling the power head, a gear assembly rotatably connecting a lower end of the drive shaft to the propeller shaft, and at least one mid-section housing member intermediate the uppermost and lowermost housing members, through which the drive shaft passes, connecting the uppermost and lowermost housing members, the improvement comprising:

a mid-section rotary bearing having longitudinal grooves along an inner circumference supporting the drive shaft intermediate the upper and lower ends thereof, the mid-section rotary bearing held in a bearing assembly mounted to one of the at least one mid-section housing member, the bearing assembly having a tubular fluid connection to the tubular passage for cooling the mid-section rotary bearing.

8. The improvement according to claim 7 in which the mid-section rotary bearing is resiliently mounted.

9. The improvement according to claim 7 in which there are two mid-section housing members, and the mid-section rotary bearing is mounted to a lower one of the mid-section housing members.

10. The improvement according to claim 7 in which there are two mid-section housing members, and the mid-section rotary bearing is resiliently mounted to a lower one of the mid-section housing members.

11. The improvement according to claim 7 in which there are two mid-section housing members, and the mid-section rotary bearing is mounted to an upper one of the mid-section housing members.

12. The improvement according to claim 7 in which there are two mid-section housing members, and the mid-section rotary bearing is resiliently mounted to an upper one of the mid-section housing members.

13. The improvement according to claim 7 further comprising a seal in the bearing assembly above the mid-section rotary bearing to direct cooling water downwardly.

14. For an outboard motor having a power head driving a rotary output assembly in an uppermost housing member, a vertical drive shaft having an upper end coupled to the rotary output assembly, a lower unit having a water pump and a horizontal propeller shaft in a lowermost housing member, a tubular passage in fluid connection at a first end with the water pump and at a second end with the power head for cooling the power head, a gear assembly rotatably connecting a lower end of the drive shaft to the propeller shaft, the drive shaft being supported at its upper and lower ends by power head and lower unit rotary bearings, and at least one mid-section housing member intermediate the uppermost and lowermost housing members, through which the drive shaft passes connecting the uppermost and lowermost housing members, an accessory drive shaft support comprising:

a mid-section rotary bearing having elongate axial grooves along an inner circumference for supporting the drive shaft intermediate the upper and lower ends thereof, the mid-section rotary bearing held in a bearing assembly mountable to one of the at least one mid-section housing member, the bearing assembly having a tubular fluid connection to the tubular passage for cooling and lubricating the mid-section bearing and a water seal above the mid-section bearing to restrict upward flow of the cooling water.

15. The accessory drive shaft support according to claim 14 in which the mid-section rotary bearing is resiliently mounted.

* * * * *